US005792316A

United States Patent [19]

Tsai

[11] Patent Number: 5,792,316

[45] Date of Patent: Aug. 11, 1998

[54] BLEACHING PROCESS FOR KRAFT PULP EMPLOYING HIGH CONSISTENCY CHLORINATED PULP TREATED WITH GASEOUS CHLORINE AND OZONE

[75] Inventor: Ted Yuan Tsai, Harriman, N.Y.

[73] Assignee: International Paper Company, Purchase, N.Y.

[21] Appl. No.: 132,686

[22] Filed: Oct. 6, 1993

Related U.S. Application Data

[63] Continuation of Ser. No. 843,832, Feb. 28, 1992, abandoned.

[51] Int. Cl.[6] ..... D21C 9/14; D21C 9/153; D21C 9/16

[52] U.S. Cl. ..... 162/65; 162/66; 162/89

[58] Field of Search ..... 162/65, 88, 89, 162/66, 67, 87

[56] References Cited

U.S. PATENT DOCUMENTS

| | | | |
|---|---|---|---|
| 396,325 | 1/1889 | Brin et al. . | |
| 1,957,937 | 5/1934 | Campbell et al. | 8/2 |
| 2,178,696 | 11/1939 | Muskat et al. | 8/108.1 |
| 4,080,249 | 3/1978 | Kempf et al. | 162/57 |
| 4,093,506 | 6/1978 | Richter | 162/17 |
| 4,372,812 | 2/1983 | Phillips et al. | 162/40 |
| 4,740,212 | 4/1988 | Yant et al. | 162/87 |
| 4,902,381 | 2/1990 | Meredith | 162/65 |

OTHER PUBLICATIONS

Hurst, "High Brigtness Pulp Bleaching with Monox-L"; 1988 Int. Pulp Bleach Conf; Orlando, Fla., Jun. 5–9 1988, pp. 99–106 (162–89).

Author: Marilyn M. Hurst, Title: "High Brightness Pulp Bleaching with Monox-L", Publication: 1988 Int. Pulp Bleach. Conf.; Orlando, Florida, Date: Jun. 5–9, 1988.

*Primary Examiner*—Steven Alvo

*Attorney, Agent, or Firm*—Luedeka, Neely & Graham, P.C.

[57] ABSTRACT

In the bleaching of kraft cellulosic pulps employing a stage in which the pulp is contacted simultaneously with gaseous chlorine and ozone, the improvement in which the pulp at a low to high consistency is initially chlorinated with hypochlorous acid and thereafter is contacted substantially simultaneously with gaseous chlorine and ozone. The pulp so processed exhibits enhanced brightness and good viscosity, and the process produces low quantities of environmentally undesirable chlorinated organics. The bleaching sequence of $M(C+Z)_gED$ is disclosed.

6 Claims, 2 Drawing Sheets

BLEACHING PROCESS FOR KRAFT PULP EMPLOYING HIGH CONSISTENCY CHLORINATED PULP TREATED WITH GASEOUS CHLORINE AND OZONE

This is a continuation of application Ser. No. 07/843,832 RMnL, filed Feb. 28, 1992 RMnL and now abandoned.

This invention relates to the bleaching of kraft cellulosic pulp.

Meredith, in U.S. Pat. No. 4,902,381 teaches the combination of gaseous chlorine and ozone as a delignification agent for kraft cellulosic pulps. In this patent, the chlorine and ozone are introduced simultaneously to the pulp, which is at a low consistency of between about ½ to 15%, on pulp, in a reactor as the initial step of a three-stage bleaching sequence. The second and third steps of the sequence comprise alkaline extraction and chlorination with chlorine dioxide, respectively.

The present inventor has discovered that enhanced brightness of a kraft cellulosic pulp can be obtained employing a bleaching sequence in which there is an initial stage comprising chlorination of the pulp at a medium to high consistency employing liquid hypochlorous acid or passing gaseous chlorine through a preadjusted pH from 6 to 9 in the pulp mat followed by a stage in which gaseous chlorine and ozone are added simultaneously to the chlorinated pulp followed by a conventional alkaline extraction stage, and thereafter by a conventional chlorine dioxide chlorination stage. In addition this new bleaching sequence exhibits reduced formation of chlorinated organics, specifically dioxins such as 2,3,7,8 tetrachloro-dibenzo-dioxin, 2,3,7,8 tetrachloro-dibenzo-furan.

More specifically, the present invention contemplates the kraft pulp bleaching sequence of $M(C+Z)_gED$ where M represents the addition to the pulp of hypochlorous acid with the pulp at a consistency of between about 3% and about 40%, $(C+Z)_g$ represents the addition, in a single stage, to the pulp of gaseous chlorine and gaseous ozone, E represents a conventional alkaline extraction stage, and D represents the addition to the pulp of chlorine dioxide in a conventional chlorine dioxide bleaching stage.

It is therefore an object of the present invention to provide an improved bleaching process for kraft cellulosic pulp.

It is another object to provide an novel bleaching process for kraft cellulosic pulp in which the pulp is contacted with a gaseous mixture of chlorine and ozone in a separate stage of the bleaching process, following chlorination of the pulp in an initial stage employing hypochlorous acid with the existence of stabilizers, such as amines.

BRIEF DESCRIPTION OF THE DRAWINGS

Referring to FIG. 1, in the prior art represented by U.S. Pat. No. 4,902,381, which is incorporated herein by reference, there is depicted a bleaching process in which brown stock pulp is fed from storage 12 to a first mixer 13 where chlorine from a tank car 24 and ozone from an ozone generator and storage tank (19) are mixed with the pulp. This pulp is fed through a further mixer 14 where chlorine dioxide optionally may be added to the pulp. The pulp exiting the second mixer 14 passes to the bottom of an upflow first stage reactor 15. The reactor 15 also handles the pulp at medium consistency, and the ozone/chlorine bleaching takes place there. The pulp discharged from the top of first stage 15 passes to stand pipe 30, at which point caustic (NaOH) is added and the pulp is withdrawn from the stand pipe 30 by a suitable pump 31 which pumps the pulp to the bottom of the second stage upflow reactor 16. Some oxygen is also added at the discharge of the pump 31.

After bleaching in the second, $E_o$, stage 16, the pulp, still at medium consistency (e.g. about 6–15%), is fed to stand pipe 33 at which point chlorine dioxide is added at about 1.3%. From the stand pipe 33 the pulp is pumped by a suitable pump 34 to the bottom of the third, D, bleach stage 17, with the output from the D stage being collected for use.

Figure 1:
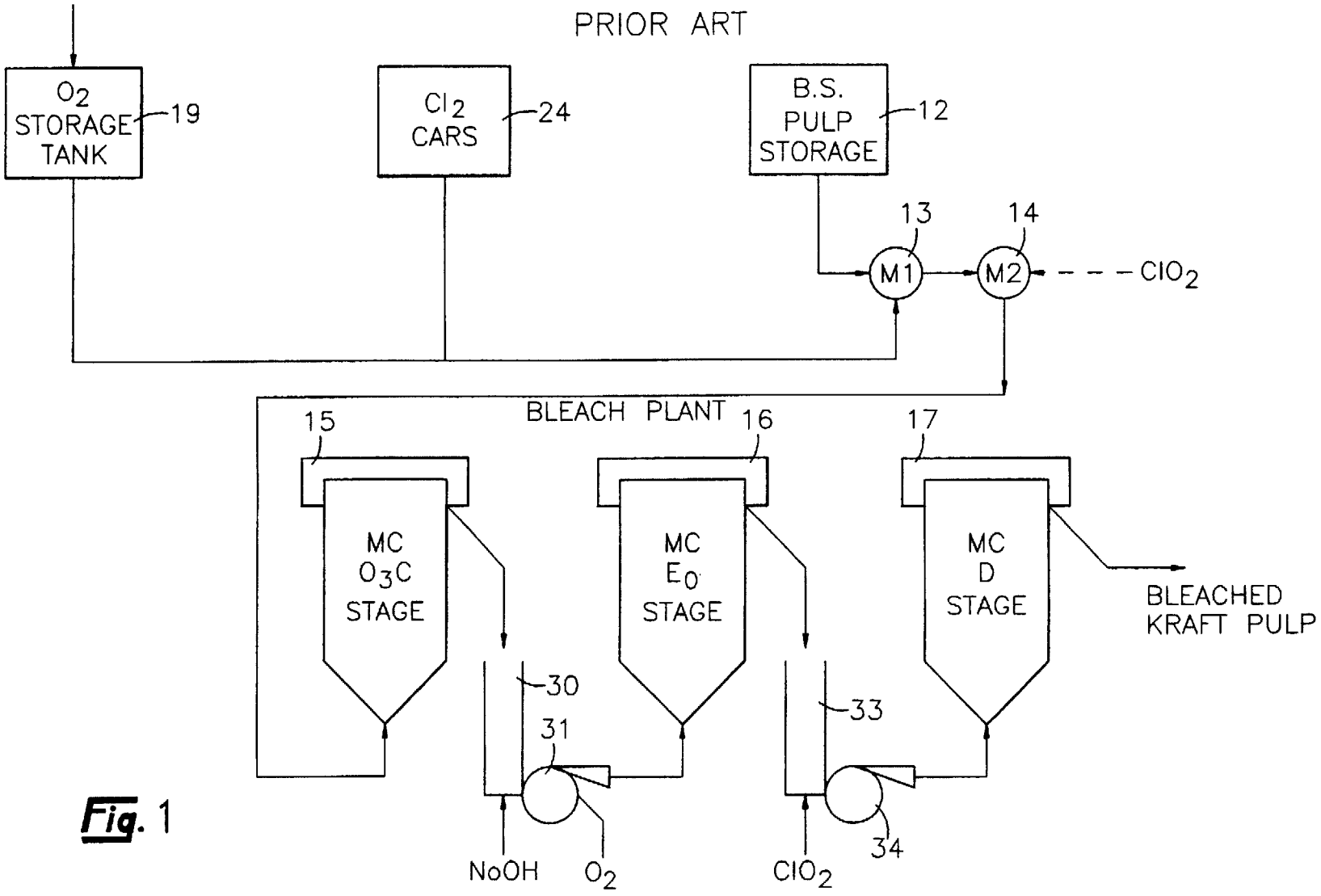
FIG. 1 is a schematic flow diagram of a prior art bleaching process for kraft cellulosic pulp and employing the simultaneous addition to the pulp, at low to medium consistency, of gaseous chlorine and ozone as the initial stage of the process.
Figure 2:
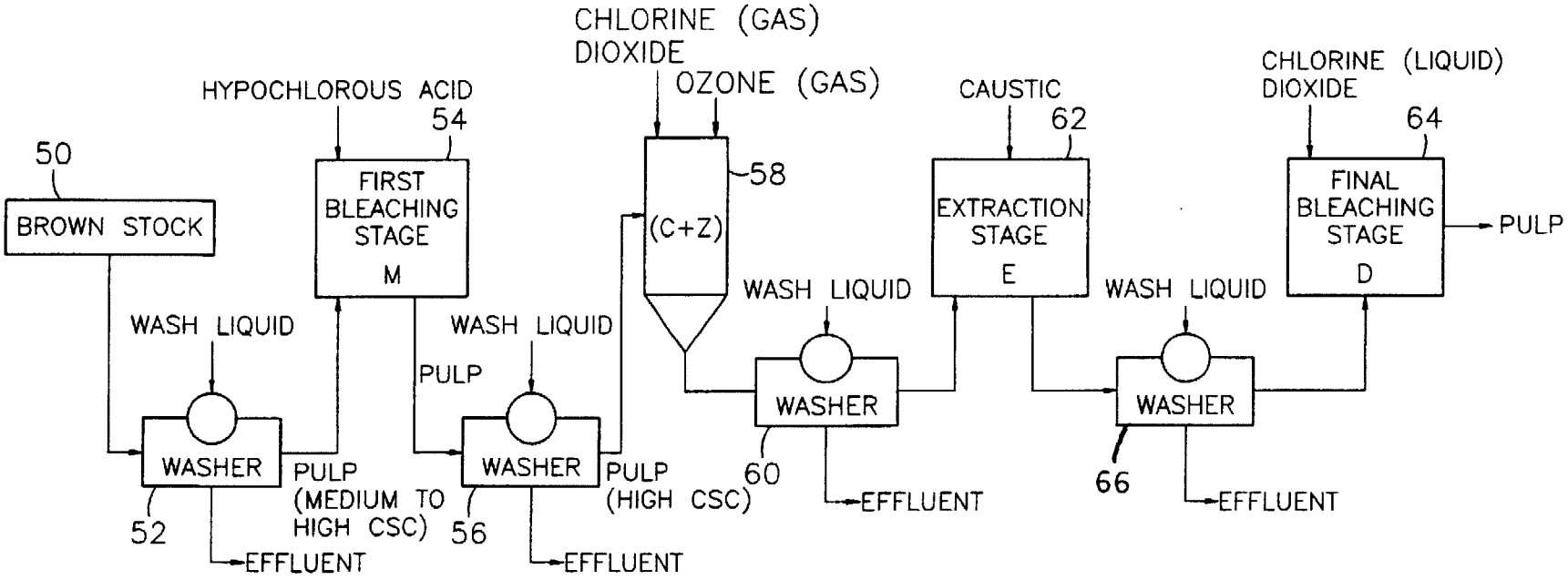
FIG. 2 is a schematic flow diagram of one embodiment of the present invention for bleaching kraft cellulosic pulp and employing the simultaneous addition to the pulp of gaseous chlorine and ozone as the second stage of a bleaching process in which the initial stage comprises contacting the pulp with hypochlorous acid.

Referring to FIG. 2, in the present bleaching process, brown stock pulp from a storage vessel 50 is fed to a first washer 52 wherein the pulp is washed with a wash liquid, such as fresh water. This pulp is fed to a first chlorination stage 54, M, at which hypochlorous acid is added to the pulp and allowed to react therewith. The chlorinated pulp from the M stage is fed through a second washer 56 (optional) wherein the pulp is again washed, preferably with fresh water and fed to a tower reactor 58. Within the tower reactor, the pulp is contacted with gaseous chlorine and gaseous ozone for a period of time sufficient for these gases to substantially react with the lignin in the pulp. Thereafter, the pulp is processed through a third washer 60, a conventional alkaline extraction stage 62, E, and a final stage 64, D, in which the pulp is contacted with liquid chlorine dioxide bleaching, for example. The pulp from the final bleaching stage is collected for use. As desired, the alkaline extraction stage may be enhanced by the addition to the pulp during this stage of oxygen, peroxide (such as hydrogen peroxide) or a combination of these enhancers.

Notably, the present claimed bleaching process provides enhanced brightness of the pulp exiting the process as compared to the prior art processes which employ the simultaneous addition of chlorine and ozone to the pulp as a bleaching stage. Table I below shows this noted improvement.

TABLE I

| Bleaching Sequences | Pulp Brightness (% GE) | Pulp Viscosity (cP) |
|---|---|---|
| $(C+Z)_gD_gED$ | 59.4 | 36.6 |
| $D_g(C+Z)_gED$ | 76.0 | 36.6 |
| $(C+Z)_gMED$ | 77.3 | 31.7 |
| $M(C+Z)_gED$ | 78.5 | 31.0 |

Notes to Table I:

1. Southern (Louisiana mill) softwood pulp, Kappa number = 27.9, viscosity = 42.0 cP.
2. Bleaching conditions:

$D_g$ stage: Gas-phase chlorine dioxide stage, 5 gram sodium chlorite mixed with 4 N sulfuric acid and 50 mls of distilled water, then the formed chlorine dioxide gas was passed through pulp mat.

$(C+Z)_g$ stage: Gas-phase chlorine and ozone mixture by passing ozone through chlorine water, Chlorine water, 150 mls at 4.69 g per liter. Ozone 5000 ppm, 1.5 liter per minute, 6.5 psig for 2 minutes.

M stage: 2.5% Hypochlorous acid (HOC1), 0.62% NaOH, 50° C., 10% csc, 45 minutes.

TABLE I-continued

| Bleaching Sequences | Pulp Brightness (% GE) | Pulp Viscosity (cP) |
|---|---|---|

E stage: 3.5% NaOH, 70° C., 1 hr, 10% csc.
D stage: 1% chlorine dioxide and 0.4% NaOH on pulp, 70° C., 10% csc, 2.5 hrs.

It will be also observed from Table I that the present process produced pulp having a viscosity that is equal to or better than the viscosity of pulps produced by prior art processes.

In addition the present process produces reduced quantities of environmentally undesirable chlorinated organics, such as 2,3,7,8 tetrachloro-dibenzo-dioxin and 2,3,7,8 tetrachloro-dibenzo-furan.

What is claimed:

1. In a process for bleaching of kraft cellulosic pulp employing the combination of gaseous chlorine and ozone in a single bleach stage, the improvement consisting essentially of initially contacting said pulp with hypochlorous acid containing sodium hydroxide at a pH ranging from about 6 to about 9 to effect chlorination of said pulp, thereafter contacting said chlorinated pulp substantially simultaneously with the gaseous chlorine and ozone in the single bleach stage in a reaction vessel, and subsequently treating said pulp sequentially with an alkaline extraction stage and a final chlorine dioxide stage.

2. The improvement of claim 1 wherein the consistency of said pulp when contacted with hypochlorous acid in said initial stage is at a consistency of between about 3% and about 40%, on pulp.

3. The improvement of claim 1 wherein said alkaline extraction stage is enhanced by a member of the group consisting of oxygen, peroxide, and combinations thereof.

4. In the bleaching of kraft cellulosic pulp employing the combination of gaseous chlorine and ozone, the improvement consisting essentially of bleaching the pulp with a bleaching sequence represented by $M(C+Z)_gED$ wherein M represents the addition to the pulp of hypochlorous acid containing sodium hydroxide to treat the pulp at a pH of about 6 to about 9, wherein $(C+Z)_g$ represents a simultaneous gaseous chlorine and ozone stage, E represents an alkaline extraction stage and D represents a chlorine dioxide stage.

5. The bleaching sequence of claim 4 wherein said E stage is enhanced by the addition to the pulp of a member of the group consisting of oxygen, peroxide, and combinations thereof.

6. The bleaching sequence of claim 4 wherein said pulp is at a consistency of between about 3% and 40%, on pulp, during the initial M stage and during the (C+Z) stage.

* * * * *